US005258656A

United States Patent [19]

Pawlick

[11] Patent Number: 5,258,656

[45] Date of Patent: Nov. 2, 1993

[54] ELECTRONIC ON/OFF TIMER APPARATUS AND METHOD INCORPORATING PREDETERMINED TIME DELAY INTERVALS

[76] Inventor: William F. Pawlick, 2022 W. Spinningwheel, Bloomfield Hills, Mich. 48304

[21] Appl. No.: 736,041

[22] Filed: Jul. 25, 1991

[51] Int. Cl.[5] ..... H01H 43/00

[52] U.S. Cl. ..... 307/141; 307/141.4

[58] Field of Search ..... 307/141, 141.4, 592, 307/595, 597, 598; 315/360; 340/309.15, 309.6; 361/195-198; 364/141, 143

[56] References Cited

U.S. PATENT DOCUMENTS

| | | | |
|---|---|---|---|
| 3,935,404 | 1/1976 | Persson | 200/35 R |
| 4,213,063 | 7/1980 | Jones, Sr. | 307/141 |
| 4,219,741 | 8/1980 | Von Gunten | 307/141 |
| 4,354,120 | 10/1982 | Schornack | 307/132 E |
| 4,521,843 | 6/1985 | Pezzolo et al. | 364/145 |
| 4,570,216 | 2/1986 | Chan | 364/143 |
| 4,668,878 | 5/1987 | Wyss | 307/141 |
| 4,695,739 | 9/1987 | Pierce | 307/141 |
| 4,712,019 | 12/1987 | Nilssen | 307/141 |

*Primary Examiner*—A. D. Pellinen
*Assistant Examiner*—Aditya Krishnan
*Attorney, Agent, or Firm*—Harness, Dickey & Pierce

[57] ABSTRACT

An electronic ON/OFF timer apparatus and method having predetermined time delay intervals. The apparatus is intercoupled between an electrical power source and an electrically powered external device such as a lamp, television, radio, etc. The apparatus generally comprises an electromechanical timer having an ON switch and an OFF switch for enabling approximate ON and OFF times to be selected, a memory for storing a predetermined plurality of randomly varying time delay intervals, and a countdown timer. An operator first selects the approximate ON and OFF times via the switches on the timer. When the approximate ON or OFF time is reached, the countdown timer is loaded from the memory with a first one of the predetermined plurality of randomly varying time delay intervals. The countdown timer then counts down a time period corresponding to the first delay time interval. When the countdown timer times out, the timer is caused to either couple or un-couple electrical power to the external device, depending upon whether the ON or OFF switch was detected, at a first actual time. Accordingly, the actual ON or OFF operation of the external device is delayed a period in accordance with the time delay interval. The invention is particularly well suited to residential applications where the ON and OFF times of electrical appliances such as lights and televisions are desired to be varied in an apparently random fashion within predetermined limits.

8 Claims, 2 Drawing Sheets

ELECTRONIC ON/OFF TIMER APPARATUS AND METHOD INCORPORATING PREDETERMINED TIME DELAY INTERVALS

BACKGROUND OF THE INVENTION

1. Technical Field of the Invention

This invention relates generally to timers, and more particularly to an electronic timer apparatus and method incorporating a plurality of predetermined, randomly varying time delay intervals to enable external devices such as lights and televisions to be turned ON and OFF at times which vary controllably and yet in random fashion.

2. Discussion

Electronic timers are used in a wide variety of applications to control the "ON/OFF" operation of electrically powered devices such as lights, televisions, radios, audio equipment, etc. In particular, such timers are frequently employed in residential dwellings to turn ON and OFF lights, televisions, etc. when the occupant is away from the dwelling, such as on vacation. The automatic ON and OFF control of lights, televisions, radios and other like devices can be quite helpful in creating the appearance that the dwelling is still occupied, thus reducing the risk of burglaries, vandalism, and other like events when the occupant is away from the dwelling.

A variety of timers have been developed for controlling the ON/OFF application of electrical power to external devices with the intent of providing as realistic an appearance as possible that a dwelling where such devices are being used within is occupied, while the occupant is in fact absent from the dwelling. Such devices are disclosed in the following U.S. Pat. Nos.:

| U.S. Pat. No. | Inventor | Date Issued |
|---|---|---|
| 3,935,404 | Persson | 1/27/76 |
| 4,219,741 | Von Gunten | 8/26/80 |
| 4,570,216 | Chan | 2/11/86 |
| 4,668,878 | Wyss | 5/26/87 |
| 4,695,739 | Pierce | 9/22/87 |
| 4,712,019 | Nilssen | 12/08/87 |

With many prior art timers, a user selects a specific time at which the timer is to couple or uncouple electrical power to an electrically powered device. Accordingly, the electrically powered device is turned ON or OFF at exactly the same time of day every time the apparatus initiates ON or OFF operation of the external device.

In some instances this type of operation may be satisfactory. In many instances, however, it would be extremely desirable to vary, somewhat randomly, the exact time at which such a device initiates ON or OFF operation of an external device. For example, when using electronic timers to turn ON and OFF lights and other appliances in a home while the occupant is away, such as on vacation, it would be extremely desirable if the timer was operable to turn ON and OFF the lights of the home at slightly varying times each day, rather than at the exact same time every day. Since most individuals do not arise or retire at exactly the same time every day, varying the times at which the lights of a house go ON and OFF while the occupant is away further serves to enhance the appearance that the house is occupied and thus reduce the chance of any tampering with the house.

While some prior art timer devices have attempted to provide some degree of random ON/OFF operation of the external devices they control, such timer devices have not operated entirely satisfactory. Problems with sporadic timer operation causing lights and other appliances to be turned ON or OFF at unusual hours of the day or night have limited the efficacy of some prior art timers. Yet another problem with prior art timers has been the inability to provide a user with random, varying time delay intervals which fall within a predetermined range to enable an external device coupled to the timer to be turned ON and OFF at slightly varying (i.e., random) times.

Accordingly, it is a principal object of the present invention to provide an electronic ON/OFF timer apparatus which is operable to apply a plurality of varying time delay intervals to an approximate ON and OFF time as selected by a user, to thereby delay the ON and/or OFF operation of an external device coupled to the timer in accordance with the varying, predetermined time delays.

It is yet another object of the present invention to provide an electronic ON/OFF timer apparatus which provides a means by which an approximate ON and an approximate OFF time can be selected by a user, and which will automatically apply predetermined, varying, time delay intervals each time the approximate ON or OFF time selected by the user is encountered, to thereby provide the appearance of slightly random, varying ON/OFF operation of an external device coupled to the timer.

It is still another object of the present invention to provide a method for controlling the ON/OFF operation of external devices such as lights, televisions, stereo equipment, etc., in accordance with slightly varying, randomly appearing time delays which delay ON and OFF operation of these external devices from approximate ON and OFF times selected by the user.

It is yet a further object of the present invention to provide an electronic ON/OFF timer apparatus which is relatively easy and inexpensive to construct and which couples quickly and conveniently in between an electrical power source and an electrically powered external device.

SUMMARY OF THE INVENTION

The above and other objects are accomplished by an electronic ON/OFF timer apparatus and method incorporating predetermined, varying delay intervals in accordance with preferred embodiments of the present invention. The timer apparatus generally includes a timer, memory means for storing information relating to a predetermined plurality of varying time delay intervals, and means for applying the time delay intervals to the timer.

In operation, a user of the timer apparatus selects an approximate ON and OFF time on the timer at which an external device coupled to the timer apparatus is to be turned ON or OFF. When the selected approximate time is reached, the means for applying the time delay intervals applies a first one of the varying, predetermined time delay intervals, thus delaying the actual ON or OFF time by a period equivalent to the delay interval. The ON and OFF operation of the external device is thus delayed by a time period equivalent to the delay interval.

The next time the approximate ON or OFF time is detected by the electronic timer, a second, successive, varying predetermined time delay interval is applied to the time thus delaying the ON or OFF operation of the external device by a period equal to the second time delay interval. The next time the timer detects that the approximate ON or OFF time has been reached, a third one of the predetermined plurality of successive, varying time delay intervals is applied to again delay the ON or OFF operation of the external device.

Since the predetermined delay intervals are not repetitious (i.e., they appear to vary in a random fashion), the apparatus and method of the present invention thus enables external devices to be turned ON and OFF at times which appear to vary slightly and randomly. When used in homes to turn ON and OFF devices such as lights, this serves to provide a more realistic appearance that the house is occupied when in fact the occupant is absent therefrom.

Other objects, advantages and features of the present invention will become apparent to one skilled in the art upon reading the following description and dependent claims, taken in conjunction with the following drawings.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
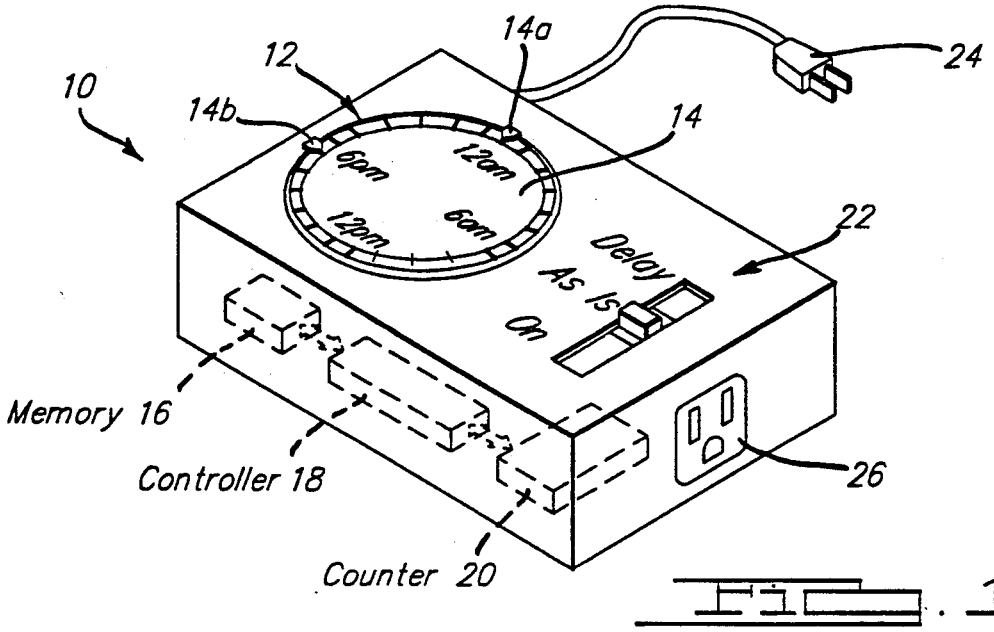
FIG. 1 is a perspective view of a timer apparatus in accordance with the present invention.

Referring to FIG. 1, a timer apparatus 10 in accordance with a preferred embodiment of the present invention is disclosed. The apparatus generally comprises an electromechanical timer 12 having an internal clock, the internal clock incorporating a dial 14; a pair of switches 14*a* and 14*b* slidably disposed about the periphery of the dial 14 for selecting approximate ON and OFF times; a memory device 16; a controller 18 incorporating a memory (such as a read-only memory (ROM)); a counter 20 in the form of a countdown timer; and a switch 22. A power cord 24 is included for coupling the apparatus 10 with an electrical power source. A female power receptacle 26 is included for enabling the apparatus 10 to be electrically coupled to an external device such as a light, stereo, television, etc. Specific details of the construction of timer apparatuses in general can be found in U.S. Pat. Nos. 3,935,404; 4,219,741; 4,570,216; 4,668,878; 4,695,739 and 4,712,019, the disclosures and teachings of which are hereby incorporated by reference.

The memory device 16 may be a random access memory (RAM), a read only memory (ROM) or a wide variety of other well known and commercially available memories for storing information. The memory 16 of the apparatus 10 stores electrical information relating to a plurality, for example, about 5 to 100, and more preferably about 30 to 100 predetermined, varying, non-repetitious (i.e., random) time delay intervals. Each of the time delay intervals are further assigned a digital code representing a sequence number.

In operation, a user selects "approximate" ON and OFF times via switches 14*a* and 14*b* at which an external device is to turn ON and OFF. If the delay feature of the present invention is to be used the switch 22 is set to the "DELAY" position. If no delay is desired, the switch may be set to the "AS IS" position causing the apparatus to turn ON and OFF the external device at the precise times selected via switches 14*a* and 14*b*. Turning the switch 22 to the ON position bypasses the timer operation and couples power continuously to the external device. It will be assumed, however, that the "DELAY" feature of the apparatus 10 has been selected. An example of four time delay intervals which may be incorporated by the apparatus and method of the present invention is as follows:

| Interval Number | Time Interval |
|---|---|
| 1 | 7 Minutes, 30 seconds |
| 2 | 22 Minutes, 37 seconds |
| 3 | 3 Minutes, 0 seconds |
| 4 | 11 Minutes, 15 seconds |

The controller 18 monitors operation of the timer 12 and reads a first one of the predetermined, varying time delay intervals stored in the memory 16, corresponding to the first sequence number, when the timer 12 detects that the approximate ON or OFF time selected by the user has been reached. For purposes of illustration, it will be assumed that the ON switch 14a has been detected.

The controller 18 then instructs the countdown timer 20 to begin counting down in accordance with the first time delay interval. The countdown timer 20 then begins counting down for a time period in accordance with the first time delay interval. When the countdown timer 20 times out (i.e., completes counting), the controller 18 couples electrical power via female receptacle 26 to the attached external device.

When the timer 12 detects that the selected, approximate OFF time has been reached, controller 18 is caused to read a second, successive one of the predetermined plurality of varying, time delay intervals stored in the memory 16, which corresponds to a second sequence number. The controller 18 then sets the countdown timer 20 in accordance with this interval. The countdown timer 20 then proceeds to countdown a time period in accordance with the second delay interval until it times out.

When the countdown timer 20 times out, the controller 18 uncouples power to female receptacle 26, and thus to the external device. When the timer 12 detects that the selected, approximate ON time has been reached again, the controller 18 is caused to read a third, predetermined, varying time delay interval in accordance with a third sequence number, and the above two mentioned cycles are repeated.

Thus, it is a principal feature that while the user has selected an approximate ON or OFF time via the timer dial 14, the actual time at which the timer apparatus 10 couples or uncouples electrical power to an external device varies slightly and randomly in accordance with the varying time delay intervals introduced by the apparatus 10. Accordingly, any external device coupled to the apparatus 10 will not turn ON and OFF at precisely the same time every time the approximate ON time selected by the user is reached. Rather, the actual time at which the external device switches ON and OFF will vary slightly in an apparently random fashion.

It should also be appreciated that a greater or lesser number of switches 14 may be incorporated to suit a wide variety of applications. For example, four switches, two ON and two OFF, could be incorporated to turn ON and OFF an external device at two different times during a twenty-four hour period.

While the apparatus 10 of the present invention is suited to an extremely wide range of applications, the apparatus 10 has particular utility when used to turn ON and OFF electrical devices such as lights, stereos, televisions and other like devices within a home while the occupant of the home is absent, such as on vacation. In such instances, prior art timers would typically turn ON and OFF such external devices at precisely the same times each day. Since the schedules of most individuals will vary at least slightly, observing the house over a several day period could provide an indication to a potential intruder that the occupant is in fact absent from the house. With the apparatus 10 of the present invention, the slightly varying, apparently random times at which lights, stereos, and other like equipment are turned ON and OFF by the time apparatus 10 provides a much more realistic appearance that the house is in fact occupied. Since the time delay intervals are predetermined, the intervals can be easily set to within desired outer limits. For example, all the intervals can be set to fall with a range of 0 to 30 minutes. Smaller or greater ranges could easily be used if desired.

With regard to the actual number of different, predetermined, time delay intervals applied by the apparatus 10, it should be appreciated that this number may vary widely in accordance with specific applications. It is preferred, however, that a range of between about 5 to 100, and more preferably about 30–100 different time delay intervals be incorporated to provide a sufficient appearance that an external device being controlled by the apparatus 10 is being turned ON and OFF in a slightly random fashion. The actual number of time delay intervals, it will be appreciated, may also be less than 5 or greater than 100 if specific applications so require. It should also be appreciated that a greater memory capacity for memory device 16 will be required as the number of different time delay intervals increases.

Figure 2A:
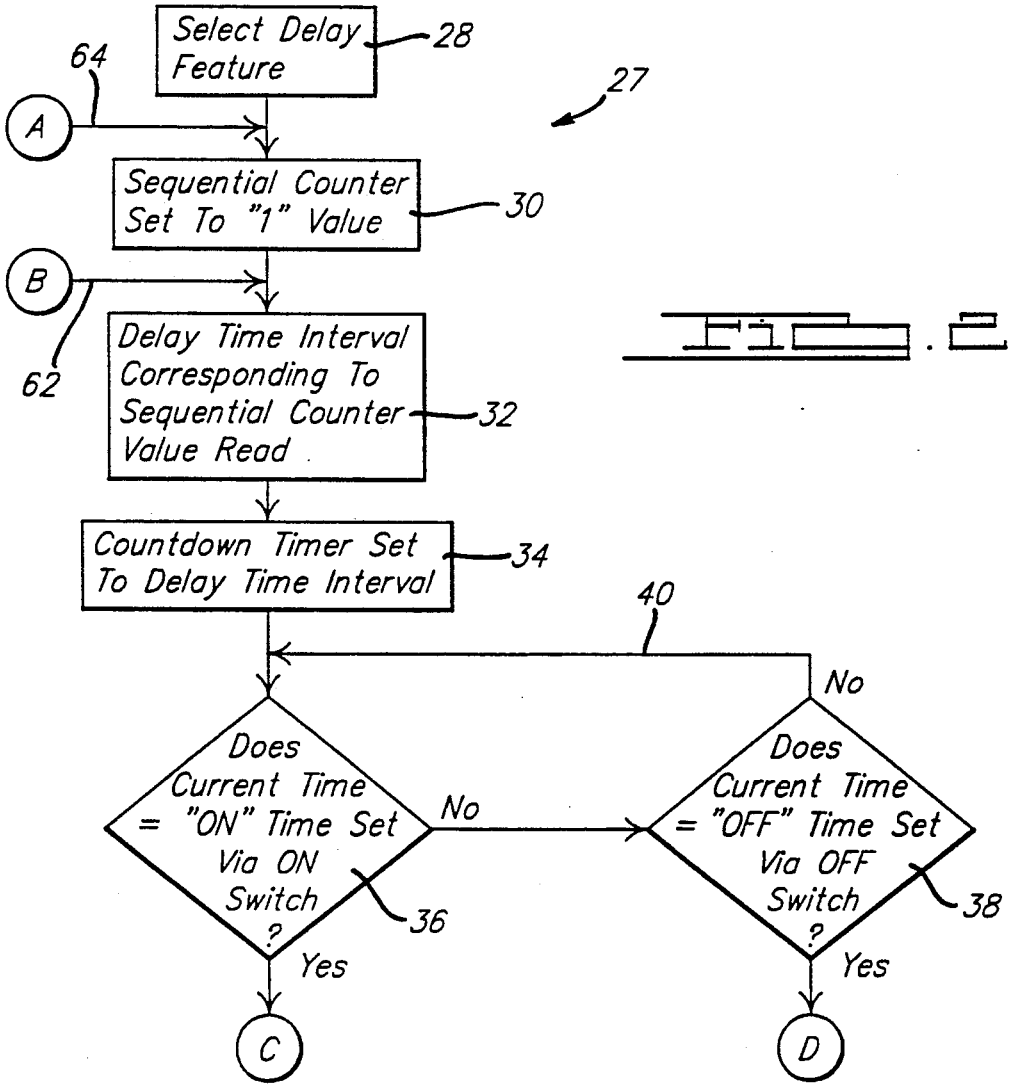
FIGS. 2A and 2B represent a flow chart illustrating a method of controlling the ON and OFF operation of an external device in accordance with a preferred method of the present invention.
Figure 2B:
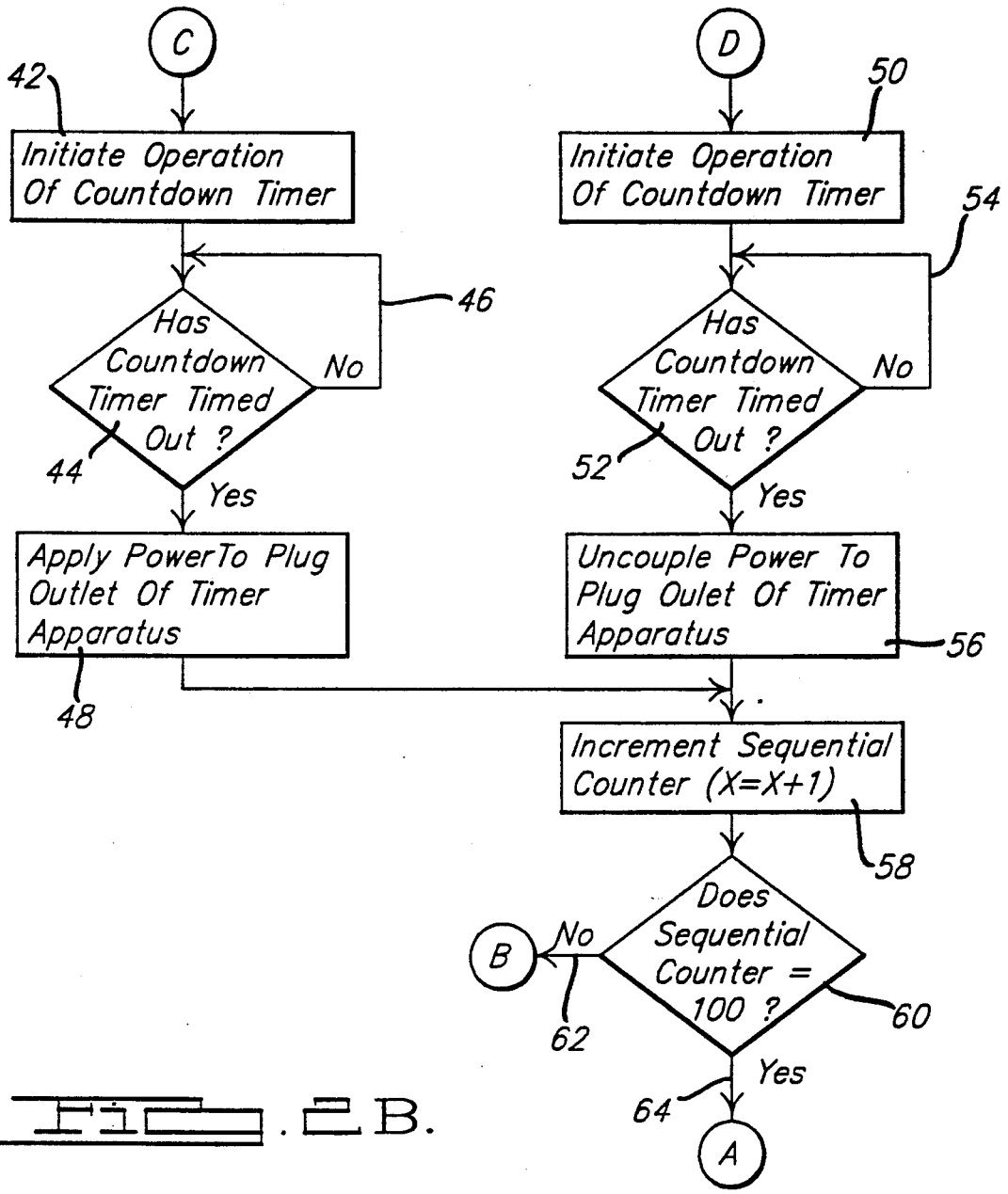

Referring now to FIGS. 2A and 2B, a description of a method of operation 27 in accordance with the present invention will be provided. Initially, the user of the apparatus 10 places the switch 22 in the "DELAY" position, as indicated at step 28, and selects an approximate ON and OFF time via switches 14*a* and 14*b*. A sequential counter established in software stored within the ROM of controller 18 is then set to a first, or "1" value, as indicated at step 30. A delay time interval corresponding to the first sequential counter value is then read by the controller 18 from the memory 16, as indicated at step 32, and the countdown timer 20 is set to the delay time interval corresponding to the first value, as shown at step 34.

Next, the current or present time is checked to see if it equals the ON time set via switch 14*a*, as indicated at step 36. If the current time does not equal the ON time then a check is made to see if the current time equals the OFF time set via switch 14*b*, as indicated at step 38. If the current time does not equal the OFF time, then another check is made to determine if the current time equals the ON time set via switch 14*a*, as indicated by line 40. Accordingly, the current time is continuously monitored and checked against the ON and OFF times selected via the switches 14*a* and 14*b* until an approximate ON or OFF time is detected.

With reference now to FIG. 2B, if an ON time is detected, operation of the countdown timer 20 is initiated, as indicated at 42. A check is then made to determine if the countdown timer is timed out, as indicated at 44. If it is determined that the countdown timer 20 has not timed out, then a continuous check of the countdown timer 20, as indicated by line 46, is made until it is detected that the countdown timer 20 has timed out. When it is determined that the countdown timer 20 has timed out, power is then applied to the female receptacle 2 of the timer apparatus 10, as indicated at step 48, thereby turning on any external device coupled to the timer apparatus 10.

With further brief reference to FIG. 2A, if the current time is detected to be equal to any OFF time set via switch 14*b*, then operation of the countdown timer 20 is initiated, as indicated at step 50 in FIG. 2B. Continuing in FIG. 2B, the countdown timer 20 is then checked to determine if it has timed out, as shown at step 52. The countdown timer 20 is continuously checked, as indicated by line 54, until it is determined that it has timed out. At this point, power is uncoupled from the female receptacle 26, as indicated at step 56, and any external device coupled to the apparatus 10 is turned off.

After power is either applied to or uncoupled from the female receptacle 26, as indicated at steps 48 and 56, the sequential counter is incremented by a count of "one", as indicated at step 58. A check is then made to determine if the sequential counter equals a predetermined, maximum count value, for example, 100, as indicated at step 60. If not, the delay time interval corresponding to the current sequential counter value is read again, as indicated by loop back lines 62 in FIGS. 2A and 2B, and step 32 in FIG. 2A. If the sequential counter does equal the predetermined maximum count value, then the sequential counter is again set to a first, or "1" value, as indicated at step 30 of FIG. 2A, via loop back lines 64. Thus, the sequential counter is incremented after every instance where a delay time interval is used and then checked to determine if the current sequence number equals the predetermined, maximum count value. When it does, the method determines that the last delay time interval stored in the memory 16 has been used and that the next delay time interval to be used is to correspond to the first sequence number.

It should therefore be appreciated that the preferred method 27 of the invention operates to apply successive, varying, predetermined time delay intervals to power ON and/or OFF an external device at times which vary slightly and apparently randomly from a selected approximate ON or OFF time. The method 27 of the present invention is thus particularly well suited for residential applications where it is desirable to turn on and off various appliances at slightly varying, and apparently random, times to enhance the appearance that a home, apartment or other like dwelling is in fact presently occupied by the occupant.

While the above description constitutes the preferred embodiments of the invention, it will be appreciated that the invention is susceptible to modification, variation, and change without departing from the proper scope or fair meaning of the accompanying claims.

What is claimed is:

1. An electronic ON/OFF timer apparatus adapted to be intercoupled in between an electrical power source and an external device, to control the ON/OFF operation of the external device, said apparatus comprising:

timer means for monitoring time;

means for selecting an approximate time at which said electrical power is to be applied to or uncoupled from said external device;

memory means for storing a predetermined plurality of randomly varying time delay intervals, each of said time delay intervals having a digital code representing a sequence number;

means for successively reading said sequence numbers and for applying said independent, randomly varying plurality of time delay intervals represented by said sequence numbers to thereby cause said timer means to delay said application of electrical power to or uncoupling of said electrical power from said external device for varying lengths of time in accordance with said plurality of predetermined, randomly varying time delay intervals.

2. The apparatus of claim 1, wherein said means for successively applying said randomly varying plurality of time delay intervals comprises:

controller means responsive to said timer means for monitoring said timer means and controlling said application of said time delay intervals; and countdown timer means responsive to said controller means for delaying coupling or uncoupling of electrical power to or from said external device.

3. The apparatus of claim 1, further comprising switch means for enabling said electrical power to be coupled continuously to said external device.

4. The apparatus of claim 1, further comprising switch means for enabling electrical power to be coupled to said external device in accordance with said approximate time selected via said means for selecting an approximate time.

5. The apparatus of claim 1, wherein said timer means comprises an electromechanical timer.

6. A method for controlling the ON and OFF application of electrical power to an electrically powered external device to cause said external device to turn ON and OFF at a plurality of times within a single twenty-four hour time period which vary from selected approximate ON and OFF times by random numbers of minutes, said method comprising:

providing a plurality of predetermined, randomly varying time delay intervals each having an associated digital code;

providing a timer responsive to said predetermined, varying time delay intervals and electrically intercoupled in between an electrical power source and an external, electrically powered device, said timer being operable to monitor time and an approximate ON or OFF time selected by a user;

during a twenty-four hour time period, once said approximate ON time is detected, causing said ON and OFF operation of said timer to be delayed in accordance with a first one of said predetermined plurality of randomly varying time delay intervals to thereby cause said timer to couple electrical power to said external device at a first actual time; and during said twenty-four hour time period, once said approximate OFF time is detected, causing said OFF operation of said timer to be delayed in accordance with a second one of said predetermined plurality of randomly varying time delay intervals to thereby cause said timer to un-couple electrical power to said external device in accordance with a second actual time; said method thus providing a plurality of randomly varying time delays within a single twenty-four hour time period.

7. The method of claim 6, further comprising:

assigning each of said predetermined plurality of randomly varying time intervals an identification number in sequential fashion; and causing said ON or OFF operation of said timer to be delayed in order in accordance with said identification numbers assigned to said predetermined plurality of randomly varying time delay intervals.

8. A method for controlling the application of electrical power via a timer apparatus intercoupled between an electrical power source and an electrically powered external device to cause said timer apparatus to turn ON and OFF said device in accordance with predetermined, randomly varying time delay intervals, said method comprising the steps of:

providing a predetermined plurality of randomly varying time delay intervals, each of said intervals being assigned an identification number in successive fashion and being accessible any number of times within any subinterval of time within a single 24 hour period;

providing a countdown timer operable to delay said ON and OFF action of said timer in accordance with said predetermined plurality of randomly varying time delay intervals during a single twenty-four hour time period;

selecting an approximate on time during said twenty-four time period at which power is to be applied to said external device;

setting said countdown timer in accordance with a first identification number in accordance with said first one of said predetermined plurality of randomly varying time delay intervals to delay the time at which said power is applied to said external device in accordance with said first time delay interval;

causing said countdown timer to countdown in accordance with said fist predetermined time delay interval;

causing said timer apparatus to couple or un-couple electrical power to said external device when said countdown timer times out;

setting said countdown timer in accordance with a second identification number corresponding to a second, successive one of said predetermined plurality of randomly varying time delay intervals within said twenty-four hour time period;

causing said countdown timer to countdown in accordance with said second delay time period associated with said second one of said predetermined plurality of randomly varying time delay intervals; and causing said timer apparatus to un-couple power to said external device when said countdown timer times out.

* * * * *

UNITED STATES PATENT AND TRADEMARK OFFICE
CERTIFICATE OF CORRECTION

PATENT NO. : 5,258,656

DATED : Nov. 2, 1993

INVENTOR(S) : William F. Pawlick

It is certified that error appears in the above-identified patent and that said Letters Patent is hereby corrected as shown below:

TITLE PAGE

Abstract, line 21; delete ", at a first actual time".

Column 3, line 4; "time" should be --timer--.

Column 5, line 26; "time" should be --timer--.

Column 6, line 17; "2" should be --26--.

Column 8, lines 37-38, claim 8; after "twenty-four" insert --hour--.

Column 8, line 48, claim 8; "fist" should be --first--.

Signed and Sealed this

Thirty-first Day of May, 1994

*Attest:*

*Attesting Officer*

BRUCE LEHMAN

*Commissioner of Patents and Trademarks*